US007207953B1

(12) United States Patent
Goicaj

(10) Patent No.: US 7,207,953 B1
(45) Date of Patent: Apr. 24, 2007

(54) MASSAGE THERAPY VEST

(76) Inventor: Irene Goicaj, 2407 Tusitala St., apt, Honolulu, HI (US) 96815

( * ) Notice: Subject to any disclaimer, the term of this patent is extended or adjusted under 35 U.S.C. 154(b) by 198 days.

(21) Appl. No.: 10/894,470

(22) Filed: Jul. 19, 2004

(51) Int. Cl.
*A61H 7/00* (2006.01)

(52) U.S. Cl. ..... 601/46; 601/95; 601/87; 601/134

(58) Field of Classification Search ..... 601/46, 601/56–58, 70, 79, 84, 87, 134, 60–62, 93–95; 2/102
See application file for complete search history.

(56) References Cited

U.S. PATENT DOCUMENTS

| | | | | |
|---|---|---|---|---|
| 1,147,560 | A | 7/1915 | Shurtleff | |
| 3,053,250 | A | 9/1962 | Stubbs | |
| 3,310,050 | A | 3/1967 | Goldfarb | |
| 3,710,784 | A | 1/1973 | Taylor | |
| 4,838,263 | A | 6/1989 | Warwick et al. | |
| 4,979,502 | A * | 12/1990 | Hunt | 601/15 |
| 5,050,587 | A | 9/1991 | Sagara et al. | |
| 5,235,967 | A | 8/1993 | Arbisi et al. | |
| 5,261,394 | A * | 11/1993 | Mulligan et al. | 601/108 |
| 5,381,558 | A * | 1/1995 | Lo | 601/134 |
| 5,938,627 | A * | 8/1999 | Hickman | 601/149 |
| 5,978,965 | A * | 11/1999 | Summers | 601/134 |
| 6,193,678 | B1 * | 2/2001 | Brannon | 601/15 |
| 6,329,638 | B1 * | 12/2001 | Bloodworth | 219/211 |
| 6,675,743 | B1 * | 1/2004 | Jeffrey et al. | 119/850 |
| 6,700,031 | B1 * | 3/2004 | Hahn | 602/41 |
| 2004/0127822 | A1 * | 7/2004 | Eisenberg | 601/49 |
| 2004/0133133 | A1 * | 7/2004 | Dreimann et al. | 601/15 |
| 2004/0260211 | A1 * | 12/2004 | Maalouf | 601/15 |
| 2005/0113724 | A1 * | 5/2005 | Wriggle | 601/46 |

FOREIGN PATENT DOCUMENTS

| | | |
|---|---|---|
| GB | 2.068.737 | 8/1981 |

* cited by examiner

*Primary Examiner*—Danton DeMille
*Assistant Examiner*—Manuj Agarwal
(74) *Attorney, Agent, or Firm*—Michael I. Kroll

(57) ABSTRACT

A wearable massage apparatus is formed from a main body having a first side. At least one massage head is positioned on the first side of the body. The apparatus further includes an arrangement for securing the main body to a user. A control module is connected to the at least one massage head for controlling movement thereof. The massage head on the first side of the main body is positioned adjacent the user's body and upon being secured thereto by the securing arrangement, the control module is selectively activated thereby causing the at least one massage head to oscillate and massage the user.

2 Claims, 15 Drawing Sheets

MASSAGE THERAPY VEST

BACKGROUND OF THE INVENTION

1. Field of the Invention

The present invention relates generally to massage equipment and, more specifically, to a massage vest having a plurality of mechanical members attached thereto. The massage area is selectively definable by the user. A control module is connected to the vest and provides means to select the region(s) to be activated, along with the type of directional or rotational motion of the balls, and the duration of the session. The vest is secured to the user with upper and lower straps that are affixed to the body of the vest.

2. Description of the Prior Art

There are other massage devices designed for massage therapy. Typical of these is U.S. Pat. No. 1,147,560 issued to Shurtleff on Jul. 20, 1915.

Another patent was issued to Stubbs on Sep. 11, 1962 as U.S. Pat. No. 3,053,250. Yet another U.S. Pat. No. 3,310,050 was issued to Goldfarb on Mar. 21, 1967 and still yet another was issued on Jan. 16, 1973 to Taylor as U.S. Pat. No. 3,710,784.

Another patent was issued to Warwick et al. on Jun. 13, 1989 as U.S. Pat. No. 4,838,263. Yet another U.S. Pat. No. 4,979,502 was issued to Hunt on Dec. 25, 1990. Another was issued to Sagara et al. on Sep. 24, 1991 as U.S. Pat. No. 5,050,587 and still yet another was issued on Aug. 17, 1993 to Arbisi et al. as U.S. Pat. No. 5,235,967.

Another patent was issued to Hickman on Aug. 17, 1999 as U.S. Pat. No. 5,938,627. Yet another U.S. Pat. No. 6,193,678 was issued to Brannon on (Feb. 27, 2001. Another was issued to Bloodworth on Dec. 11, 2001 as U.S. Pat. No. 6,329,638 and still yet another was issued on Aug. 19, 1981 to Marukawa et al. as U.K. Patent No. GB2068737.

U.S. Pat. No. 1,147,560

Inventor: Frank Shurtleff et al.

Issued: Jul. 20, 1915

A message apparatus including a belt said belt comprising a plurality of spaced rows of non-elastic blocks, non-elastic material on which said rows of blocks are bound, non-elastic straps disposed between said rows of blocks, said straps being disposed in a plane spaced from and parallel with the plane with which, the blocks lie, elastic tubes disposed between the straps and against the blocks, said belt adapted to be placed upon the body in such position that the elastic tubes lie against the body, a plurality of air tubes connected each at one end to one of the elastic tubes and at the opposite end being in communication with a source of compressed air, and. means whereby air may be forced into the elastic tubes at desired pressure and, exhausted from said elastic tubes in succession, and at desired speed.

U.S. Pat. No. 3,050,250

Inventor: Doris C. Stubbs

Issued: Sep. 11, 1962

A therapeutic device comprising a jacket-like garment component adapted to be suspended from the shoulders and to be secured about the torso of a patient and having a plurality of interconnected pockets formed therein, and a plurality of electro-magnetic vibration imparting devices removably mounted one each in each of said pockets and including a conductor means attachable to a source of alternating current and connected to all of said devices, said devices being operative upon electrical energization thereof to simultaneously apply vibratory treatment to a plurality of areas of the torso of the patient.

U.S. Pat. No. 3,310,050

Inventor: Herman Goldfarb

Issued: Mar. 21, 1967

A therapeutic garment for applying predetermined mechanical pulsations to the pulmonary lobes of the body to dislodge accumulations of mucus in the respiratory system, said garment being dimensioned to overlie the chest and back of a body, said garment carrying a plurality of means for impacting the body, means for securing said impacting means to said garment at locations adapted to directly and selectively overlie the chest and back, said impacting means adapted to impact the body at predetermined successive areas by applying pulsating forces thereto directed substantially perpendicular to the underlying skin with said forces having sufficient strength to dislodge accumulations of mucus in the underlying respiratory system.

U.S. Pat. No. 3,710,784

Inventor: Clarence R. Taylor

Issued: Jan. 16, 1973

A massaging device comprising a plate adapted when vibrated by any suitable vibrating device and placed into intimate contact with a portion of a body to massage the portion. The plate is preferably flexible, and provided with projections extending from one surface thereof. A heating pad is held in register with the plate surface; the pad having openings through which the projections extend. The plate and pad are preferably provided with a belt or straps having fastening means for releasably securing the massaging device to the body portion with the heating pad and projection ends in engagement with the body portion. Alternatively, the massaging device may be provided with a handle by which the device may be manually placed into intimate contact with the body portion.

U.S. Pat. No. 4,838,263

Inventor: Warren J. Warwick et al.

Issued: Jun. 13, 1989

Oscillatory chest compression apparatus to aid in loosening and eliminating mucus from the lungs of a cystic fibrosis patient. The apparatus includes a mechanism for applying pressurized air to a bladder covering the chest of a person and a mechanism for venting pressurized air from the bladder. In addition, the apparatus includes a mechanism for supplying the air to the bladder in a regular pattern of pulses. The application of the pressurized pulses and the pulse rate is controllable by the patient.

U.S. Pat. No. 4,979,502

Inventor: Troy T. Hunt

Issued: Dec. 25, 1990

A vibrator/heating apparatus is adapted to provide selected and variable vibration and/or heat to specific portions of the human body using respective vibrator and heaters and respectively controlled by first and second manually operable controllers and powered by ac/dc converters to apply power to the controllers and the vibrator, heater, controller and power supply are mounted to housing that conforms to a particular part of the human body.

U.S. Pat. No. 5,050,587

Inventor: Shinji Sagara

Issued: Sep. 24, 1991

Disclosed is a novel vibrator system which comprises an ultrasonic motor; a driver circuit which supplies a forwardly-rotatory and reversely-rotatory signals to the ultrasonic motor; and a switching control circuit which alternately switch the signals. The vibrator system attains a high energy efficiency even when miniaturized, as well as normally working without causing a large operation noise when loaded. The vibrotherapeutic device wherein the vibrator system is assembled can be advantageously used to massage human body.

U.S. Pat. No. 5,235,967

Inventor: Dominic S. Arbisi

Issued: Aug. 17, 1993

A therapeutic impact massager for massaging a body region of a person. The impact massager includes a frame mounted within a flexible fabric support member. The frame includes a plurality of compartments that movably receive conductive elements. Drive coils are mounted within the compartments adjacent to the conductive elements and produce a first pulsed magnetic field. The first pulsed magnetic field induces a second magnetic field within the conductive elements. The first and second magnetic fields interact to force the conductive elements towards the body region of a person to impact thereupon. A capacitor for storing electrical energy is coupled to the drive coils. A switch is coupled in series with the capacitor and drive coils and is movable between the closed state which allows electrical energy to flow from the capacitor to the drive mechanism, and an open state which prevents the discharge of electrical energy through the drive coils. A microprocessor is coupled to the switch and generates a logic command that shifts the switch between opened and closed states. The microprocessor is configured to energize the drive coils in a periodic and patterned manner to repeatedly force the conductive elements toward the body region which imparts a rhythmic wave massaging effect thereto. The impact massager preferably is in the form of a therapeutic garment that overlies the chest and back of a wearer. The therapeutic garment is designed to be used by persons with cystic fibrosis to alleviate the accumulation of mucus within the lungs.

U.S. Pat. No. 5,938,627

Inventor: Tommie N. Hickman

Issued: Aug. 17, 1999

A pneumatic massage therapy device 10 for massaging an individual's torso wherein the device 10 includes a vest member 20 provided with a branched inflatable tubing unit 12 operatively connected to massage disks 30. A pulsating pneumatic force is provided to the branched tubing unit 12 to move the massage disks 30 in a massaging motion relative to the user's torso.

U.S. Pat. No. 6,193,678

Inventor: Sammy S. Brannon

Issued: Feb. 27, 2001

A massaging system that includes a mechanism for positioning and holding vibrating and heating units onto the body at user selected locations. The massaging system includes a vest unit including a hook and pile covered interior surface and at least one user-adjustable, massaging and heat unit compression band attached to an exterior of the vest unit; at least one heating pad unit including a heating pad connecting jack, hook and pile fastener strips on a first exterior surface of the heating pad exterior that are companionate with the hook and pile covered interior surface of the vest unit, and a vibration unit hook and pile fastener attaching section provided on a second exterior surface that is the same hook and pile material as the hook and pile covered interior surface of the vest unit; and at least one vibration unit having a vibration unit connecting jack and hook and pile fastener strips on the exterior thereof that are companionate with the hook and pile covered interior surface of the vest unit.

U.S. Pat. No. 6,329,638

Inventor: Vicky W. Bloodworth

Issued: Dec. 11, 2001

A heat vest system that includes a garment wearable by the user having strategically located vibration and heating elements which is worn by the user such that the heating and vibration elements are correctly positioned for a therapeutic effect. To increase the therapeutic effect, the system includes a control device in connection with the vibration and heating elements of the garment which allows the user to separately adjust the heat and vibration generated by each of the heating and vibration elements.

U.S. Patent Number GB 2 068 737

Inventor: Toshio Marukawa et al.

Issued: Aug. 19, 1981

A massager is composed of a linear compressor having a piston which is intermittently attracted by an electromagnet and at other times repelled by a spring to produce compressed air having a safe pressure, i.e. having a relatively low difference between the rated pressure, a distributor for allowing compressed air fed from the compressor to be selectively discharged therefrom, and a bag having a plurality of air-tight sections (not shown) which are successively expanded by receiving the compressed air fed from the distributor, which includes a rotary member and a stationary member formed with passages therethrough for also allowing exhaust of the compressed air from the air-tight sections.

While these massage devices may be suitable for the purposes for which they were designed, they would not be as suitable for the purposes of the present invention, as hereinafter described.

SUMMARY OF THE PRESENT INVENTION

The present invention relates generally to massage equipment and, more specifically, to a massage vest having a plurality of mechanical members attached thereto. The massage area is selectively definable by the user. A control module is connected to the vest and provides means to select the region(s) to be activated, along with the type of directional or rotational motion of the balls, and the duration of the session. The vest is secured to the user with upper and lower straps that are affixed to the body of the vest.

A primary object of the present invention is to provide a massage vest that overcomes the shortcomings of the prior art.

Another object of the present invention is to provide a massage vest whereby a user can receive massage therapy.

Another object of the present invention is to provide a massage vest having a plurality of selectively controllable mechanical members.

Yet another object of the present invention is to provide a massage vest having straps whereby a user can adjust the pressure applied by the mechanical members.

Still yet another object of the present invention is to provide a massage vest having a control module for varying the type of massage therapy.

Another object of the present invention is to provide a massage vest having means for selecting the type of massage therapy and the duration of said therapy.

Yet another object of the present invention is to provide a massage vest encompassing the back, shoulders, and neck of the wearer.

Additional objects of the present invention will appear as the description proceeds.

The present invention overcomes the shortcomings of the prior art by providing a massage vest having a plurality of mechanical members attached thereto whereby a user can selectively define the area(s) to receive massage therapy. A control module is connected to the vest provides means to select the region(s) to be activated, along with the type of directional or rotational motion of the balls, and the duration of the session. The vest is secured to the user with upper and lower straps that are affix to the body of the vest.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Figure 14:
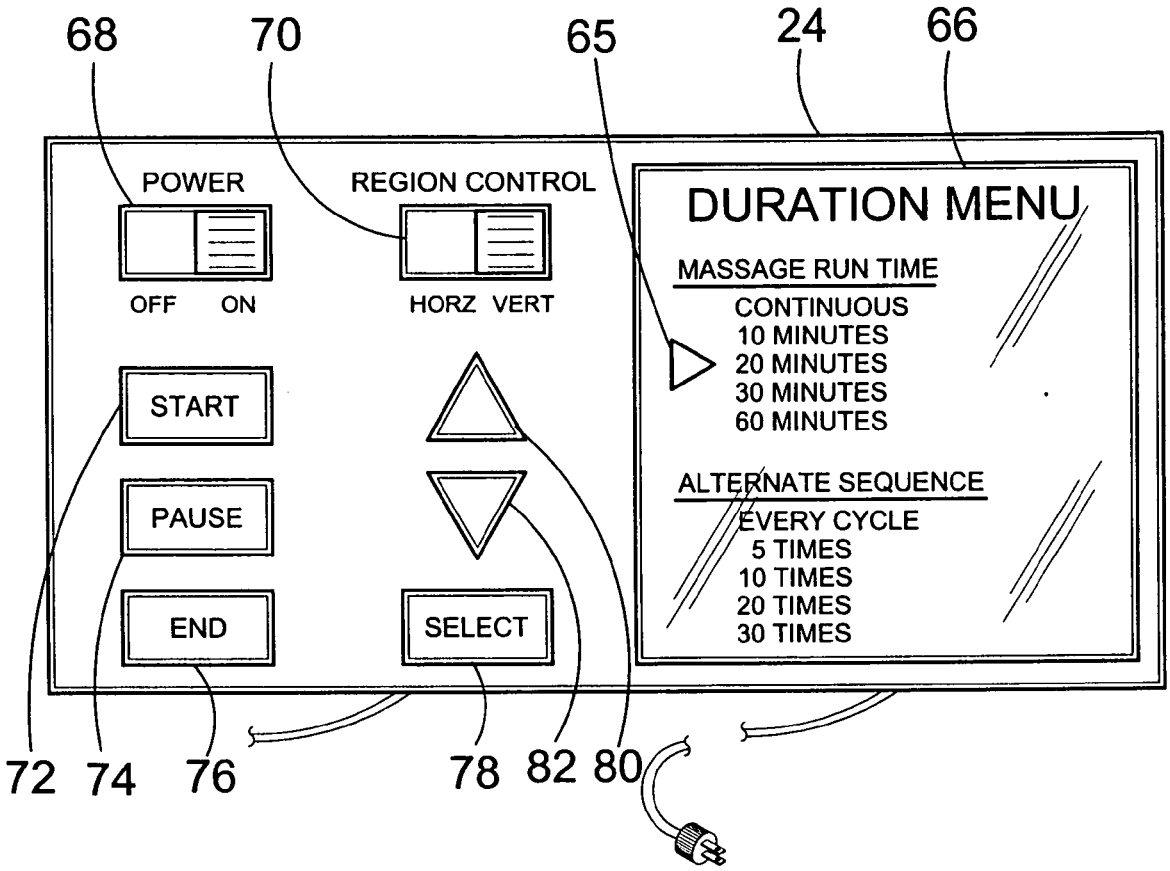
Figure 15:
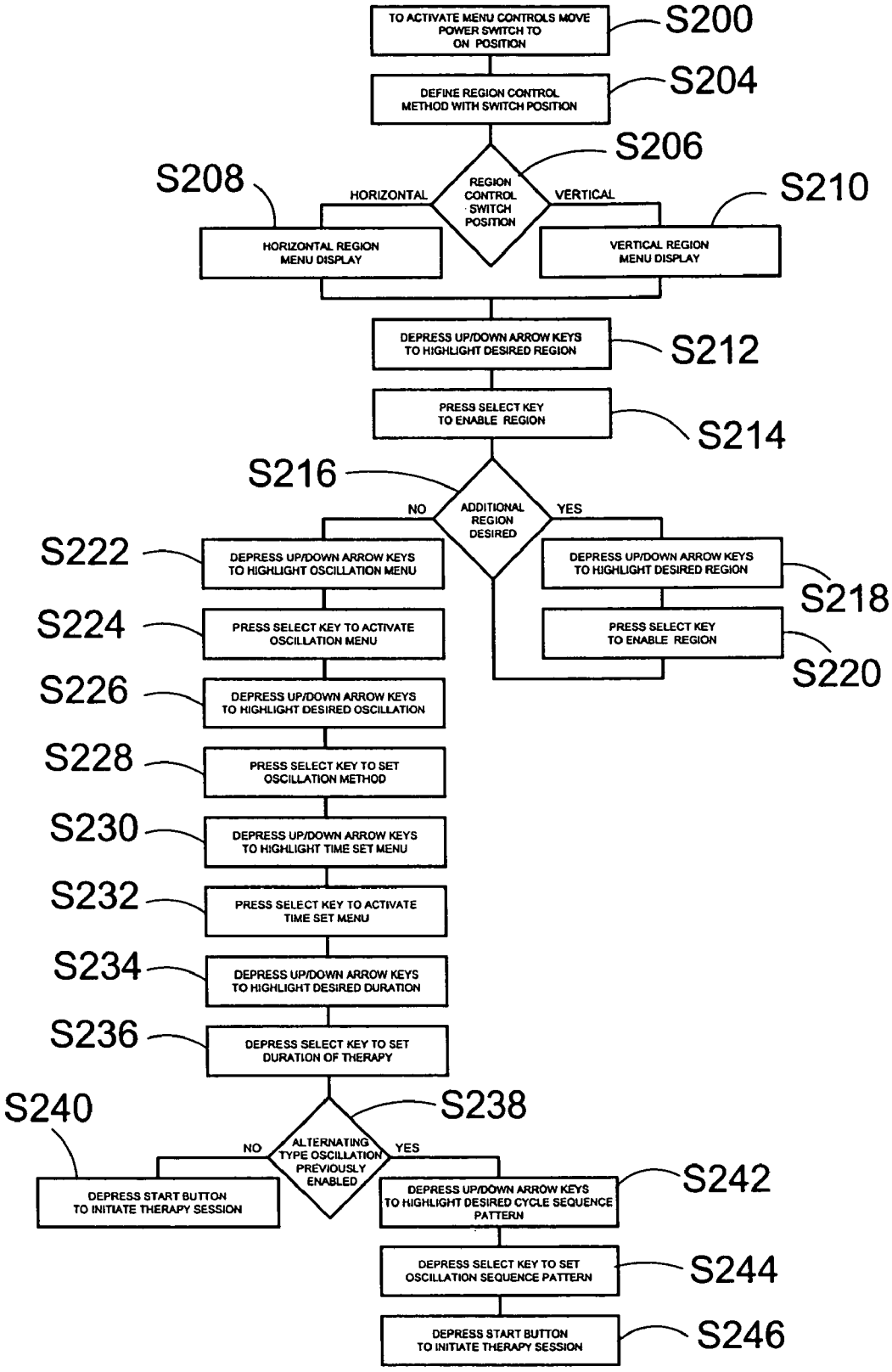

FIG. 14 a front view of the control module of the massage vest of the present invention; and FIG. 15 is a flow chart of the operation and control of the massage vest of the present invention.

DESCRIPTION OF THE REFERENCED NUMERALS

Turning now descriptively to the drawings, in which similar reference characters denote similar elements throughout the several views, the Figures illustrate the massage vest of the present invention. With regard to the reference numerals used, the following numbering is used throughout the various drawing Figures.

10 massage vest of the present invention
11 user
12 vest body
13 first side
14 first strap
16 second strap
18 third strap
20 hook and loop fasteners
22 massage members
24 control unit
26 portable power source
28 plug
30 massage head motors
32 wires
34 vertical neck zone
36 upper zone

38 mid-upper zone
40 mid-lower zone
42 lower zone
44 horizontal neck zone
46 left zone
48 left center zone
50 right center zone
52 right zone
54 operation and control method
56 regional control
58 oscillation control
60 duration control
62 vertical regions
64 horizontal regions
66 display screen
68 power switch
70 region selection switch
72 start button
74 pause button
76 end button
78 option selection button
80 up directional arrow
82 down directional arrow
84 single oscillation mode
86 horizontal pivot
88 vertical pivot
90 rotational pivot
92 sequenced oscillation mode
94 first sequence mode
96 second sequence mode
98 massage time
100 first time
102 second time
104 third time
106 fourth time
108 fifth time
110 sixth time
112 alternate sequence
114 every cycle
116 five times
118 ten times
120 twenty times
122 thirty times
124 other

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 15 illustrate a massage vest of the present invention indicated generally by the numeral 10.

Figure 1:
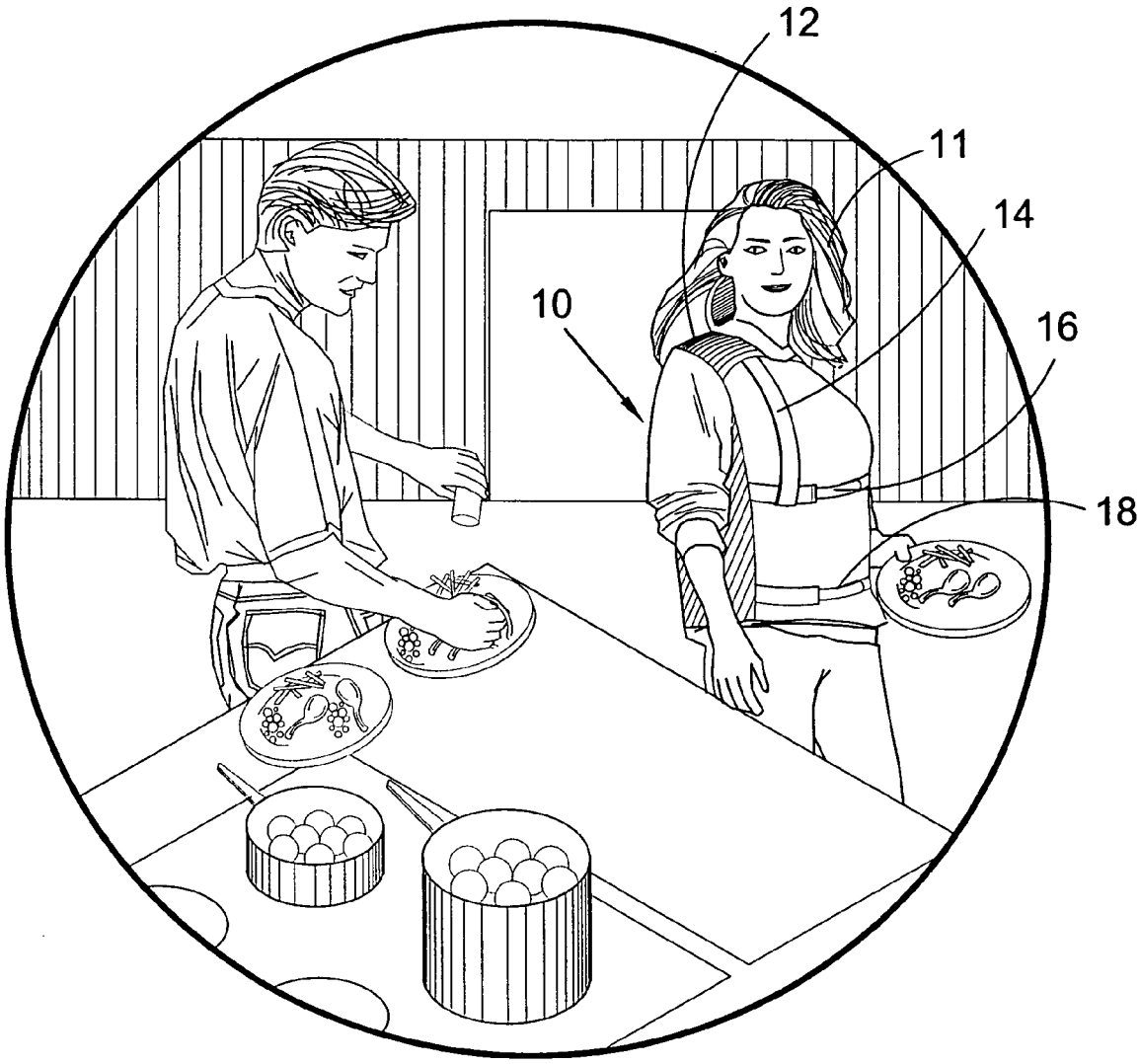
FIG. 1 is an illustrative view of the massage vest of the present invention in use.
Figure 2:
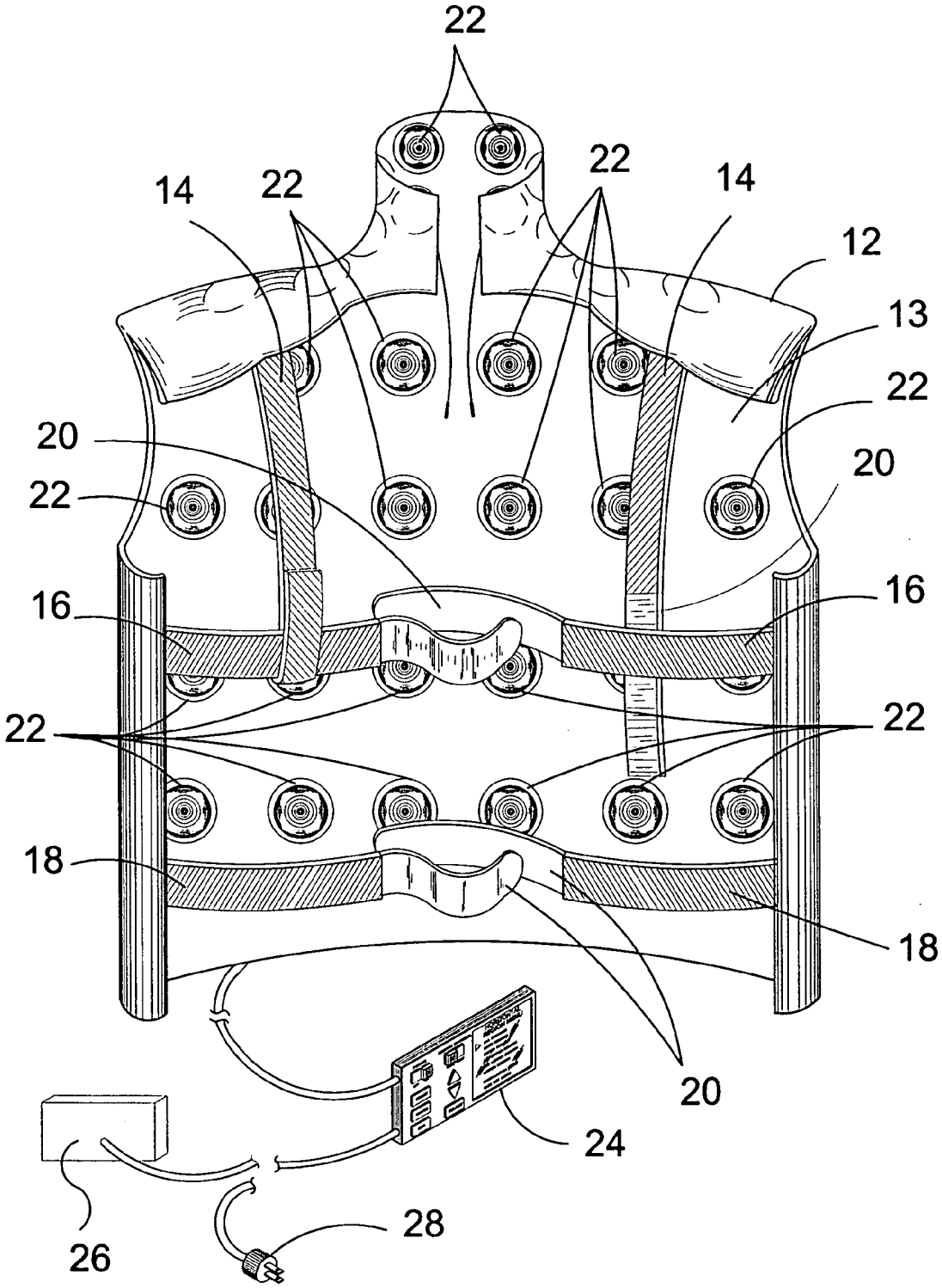
FIG. 2 is a face view of the massage vest of the present invention showing the massaging members.

FIG. 1 is an illustrative view of the massage vest 10, hereinafter "vest", of the present invention in use. A user 11 is shown wearing the vest 10 of the present invention. The vest 10 is formed from a body 12 having a plurality massage members 22 as shown in FIGS. 2–15. The massage members oscillate in various controlled directional and rotational movements providing a therapeutic massage to the user 11. The body 12 has a first strap 14 and a second strap 16 for securing the vest 10 to the shoulders and torso of the user 11. A third strap 18 is also connected to the body 12 and secured around the lower torso or waist of the user 11. Preferably, the straps 14, 16, 18 include hook and loop fasteners as shown in FIG. 2 for securing to one another. The user 11 is able to selectively control the massage pattern and duration using a control module 24 as shown in FIGS. 2–15.

Figure 5:
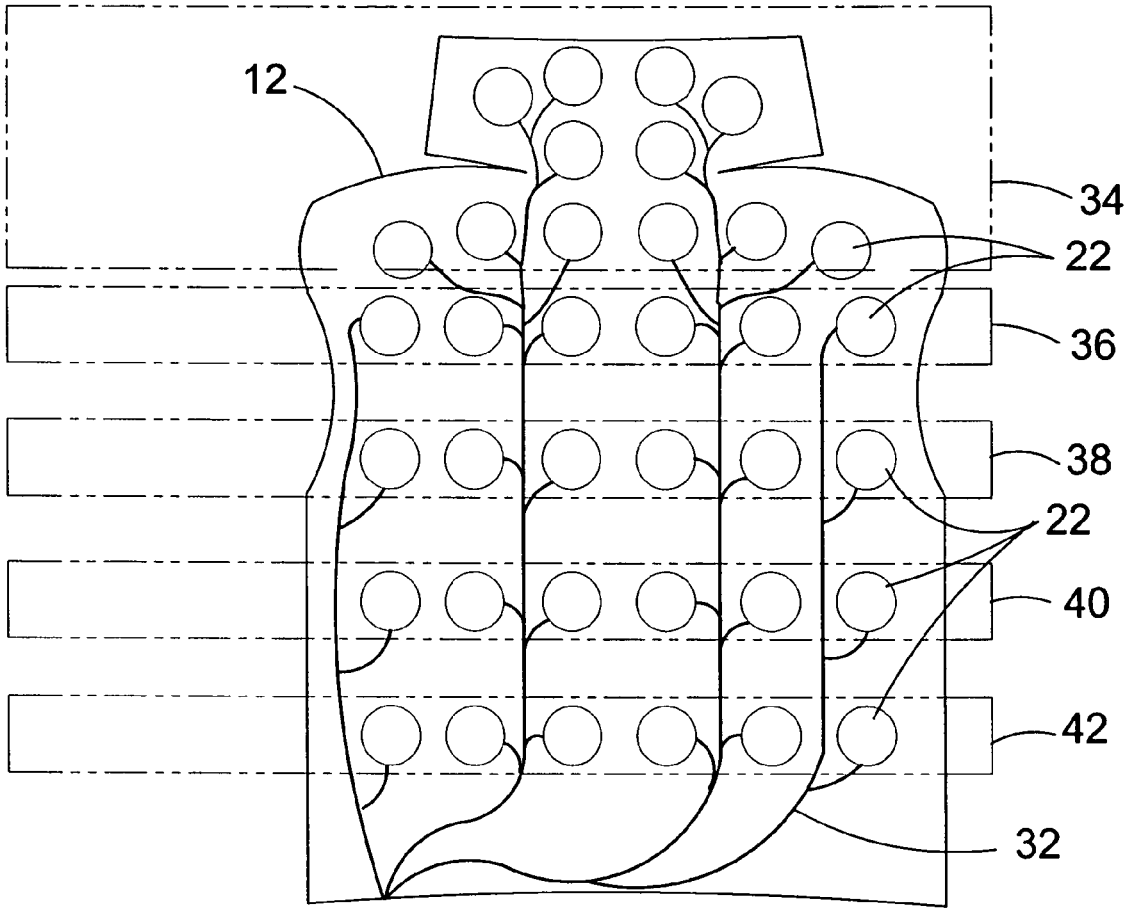
FIG. 5 is an illustrative view of vertical massage zones of the massage vest of the present invention.
Figure 6:
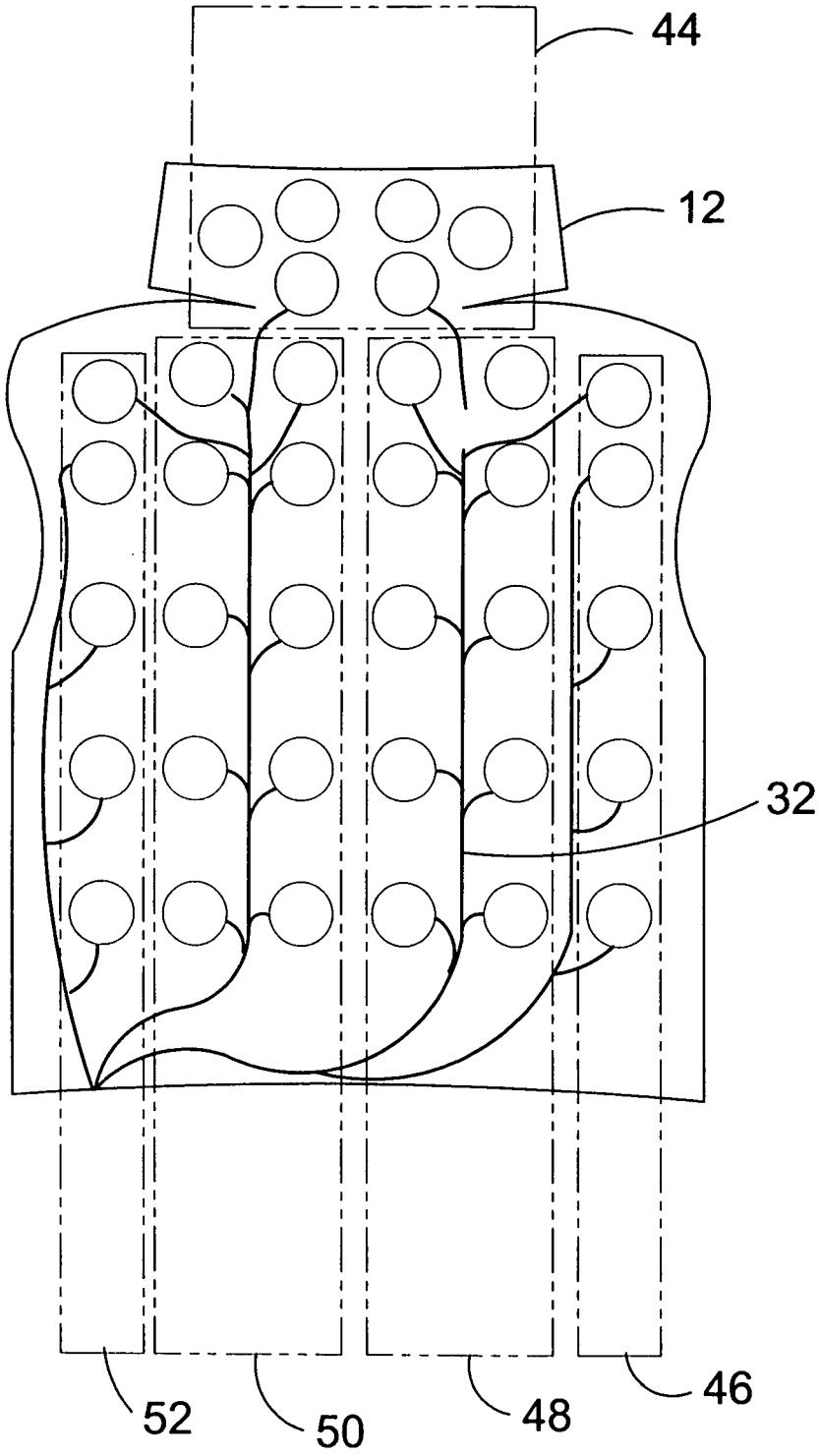
FIG. 6 is an illustrative view of horizontal massage zones of the massage vest of the present invention.

FIG. 2 is a face view of the massage vest of the present invention showing the massaging members. The vest 10 includes the vest body 12 having a first side 13 with at least one massage member 22 positioned thereon. Preferably, the vest 10 includes a plurality of massage members 22 positioned thereon for massaging a plurality of zones on the back and neck of the user 11 as shown in FIGS. 5 and 6. The body 12 also preferably extends so as to cover the shoulders of the user 11 so as to provide therapeutic massage to the shoulder area as well.

The body 12 of the vest 10 is secured to a user via hook and loop fasteners 20 positioned at an end of each of the straps 14, 16 and 18. The first strap 14 extends outward from a top of the body 12 which is positioned adjacent the shoulder of the user 11. The second strap 16 is extends outward from the body 12 at an area substantially below the armpit of the user 11. The second straps 16 are secured to one another via the hook and loop fasteners 20. The first strap 14 is wrapped around the second strap 16 and secured on itself via the hook and loop fasteners 20. The third strap 18 also extends from the body 12 of the vest at substantially the waist of the user 11. The third strap 18 is secured to one another via the hook and loop fasteners 20. Upon securing each of the straps 14, 16, 18 to one another, the vest 10 is secured to the body of the user 11.

Figure 4:
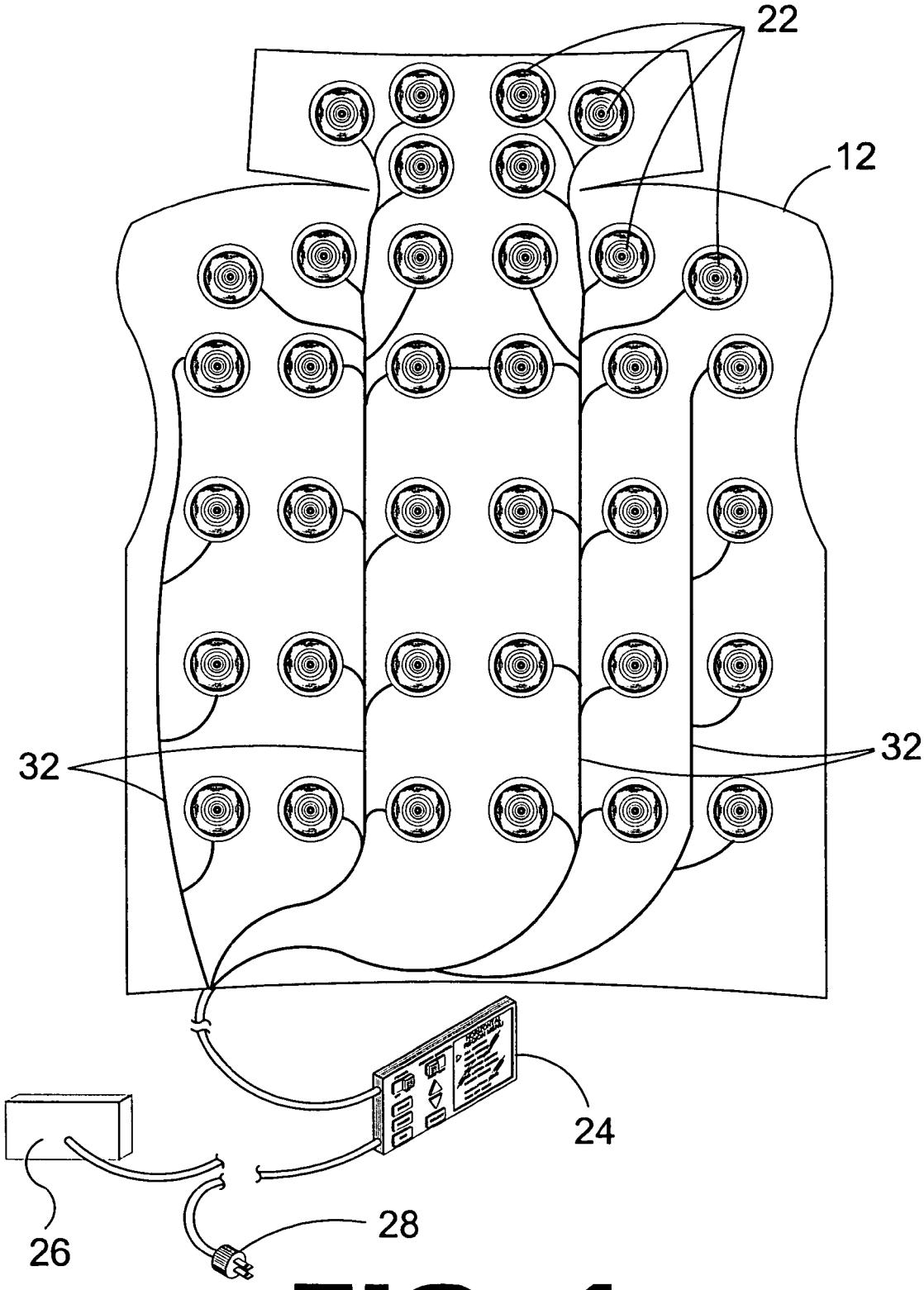
FIG. 4 is cutaway illustrative view of the massage vest of the present invention showing the wired connection of the massage members.

The user 11 can selectively control the oscillation of the massage members 22 using the control module 24. The control module 24 is connected via wires 32, as shown in FIGS. 4–6 to each respective massage member 22 for control thereof. Operation and use of the control module 24 will be discussed hereinafter with specific reference to FIGS. 7–14.

The massage vest 10 of the present invention is powered by at least one of a portable power source 26 and a hardwire power source 28 such as a plug. Each of the power sources are selectively connectable to the control module 24 and provide power to the plurality of massage members 22. The portable power source 26 is preferably a rechargeable battery pack that enables the user 11 to be mobile while wearing the vest 10. Alternatively, the user may desire to remain stationary and therefore could use the plug 28 to plug into a standard wall outlet.

Figure 3:
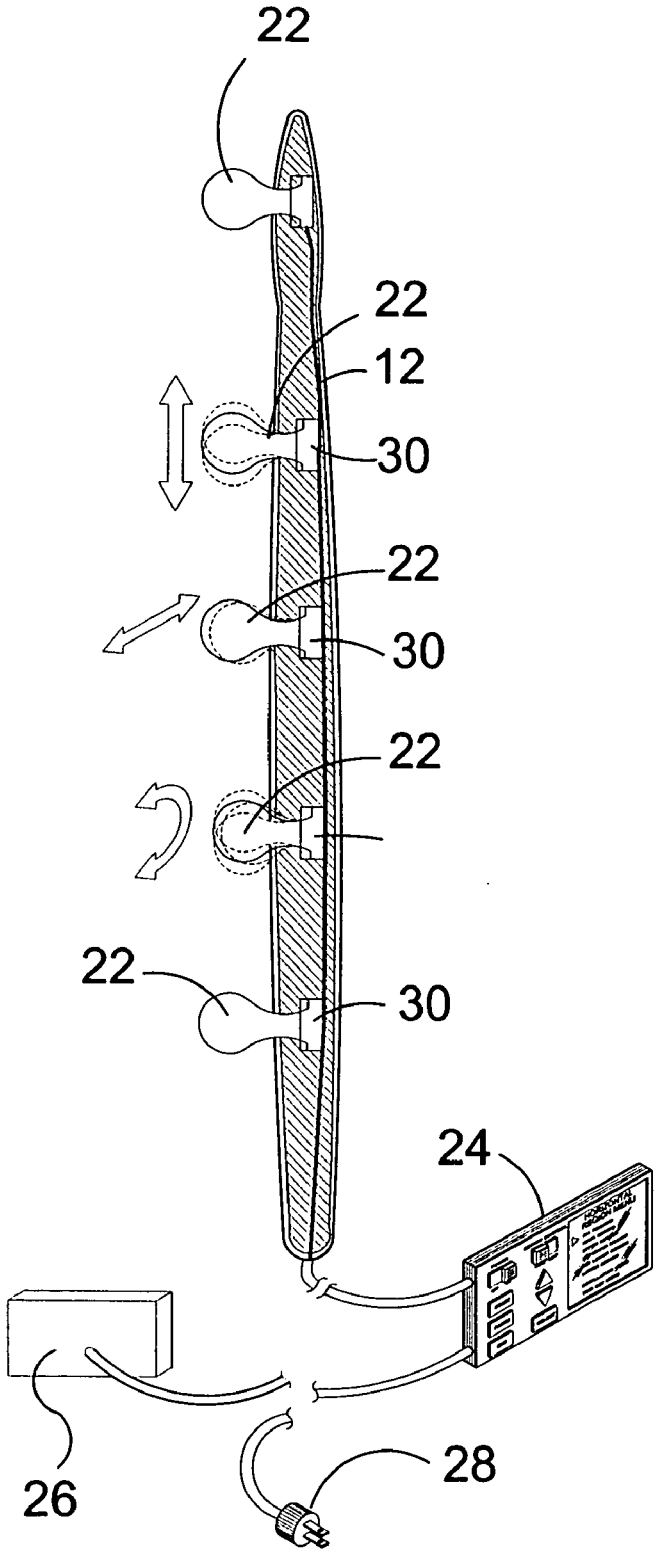
FIG. 3 is a cross-sectional view of the massage vest of the present invention taken along line 3—3 in FIG. 2.

FIG. 3 is a cross-sectional view of the massage vest of the present invention taken along line 3—3 in FIG. 2. The vest 10 includes the vest body 12 having a first side 13 with at least one massage member 22 positioned thereon. Preferably, the vest 10 includes a plurality of massage members 22 positioned thereon for massaging a plurality of zones on the back and neck of the user 11 as shown in FIGS. 5 and 6. The body 12 also preferably extends so as to cover the shoulders of the user 11 so as to provide therapeutic massage to the shoulder area as well. Each massage member 22 includes a massage motor 30. The massage motor 30 causes the massage member to oscillate in a plurality of directions. Specifically, the massage motor 30 causes the massage member 22 to pivot about an axis. As shown in FIG. 3, the massage motor 30 selectively causes the massage member to pivot in at least one of a horizontal direction, a vertical direction, and a 360 degree rotational pivot. Each of the above pivot directions are shown in phantom in FIG. 3. The plurality of pivot directions allows for the user to selectively determine the style and type of massage which is provided by the vest 10 of the present invention.

The user 11 can selectively control the oscillation of the massage members 22 using the control module 24. The control module 24 is connected via wires 32, as shown in FIGS. 4–6 to each respective massage member 22 for control thereof. Operation and use of the control module 24 will be discussed hereinafter with specific reference to FIGS. 7–14.

The massage vest 10 of the present invention is powered by at least one of a portable power source 26 and a hardwire power source 28 such as a plug. Each of the power sources are selectively connectable to the control module 24 and provide power to the plurality of massage members 22. The portable power source 26 is preferably a rechargeable battery pack that enables the user 11 to be mobile while wearing the vest 10. Alternatively, the user may desire to remain stationary and therefore could use the plug 28 to plug into a standard wall outlet.

FIG. 4 is cutaway illustrative view of the massage vest of the present invention showing the wired connection of the massage members. The vest 10 includes the vest body 12 having a first side 13 with at least one massage member 22 positioned thereon. Preferably, the vest 10 includes a plurality of massage members 22 positioned thereon for massaging a plurality of zones on the back and neck of the user 11 as shown in FIGS. 5 and 6. The body 12 also preferably extends so as to cover the shoulders of the user 11 so as to provide therapeutic massage to the shoulder area as well. Each massage member 22 includes a massage motor 30. The massage motor 30 causes the massage member to oscillate in a plurality of directions. Specifically, the massage motor 30 causes the massage member 22 to pivot about an axis. As shown in FIG. 3, the massage motor 30 selectively causes the massage member to pivot in at least one of a horizontal direction, a vertical direction, and a 360 degree rotational pivot. Each of the above pivot directions are shown in phantom in FIG. 3. The plurality of pivot directions allows for the user to selectively determine the style and type of massage which is provided by the vest 10 of the present invention.

The user 11 can selectively control the oscillation of the massage members 22 using the control module 24. The control module 24 is connected via wires 32, as shown in FIGS. 4–6 to each respective massage member 22 for control thereof. Operation and use of the control module 24 will be discussed hereinafter with specific reference to FIGS. 7–14. The massage members 22 of the present invention massage vest are wired together with wires 32 to provide the user means to activate and deactivate selected massage members 22.

The massage vest 10 of the present invention is powered by at least one of a portable power source 26 and a hardwire power source 28 such as a plug. Each of the power sources are selectively connectable to the control module 24 and provide power to the plurality of massage members 22. The portable power source 26 is preferably a rechargeable battery pack that enables the user 11 to be mobile while wearing the vest 10. Alternatively, the user may desire to remain stationary and therefore could use the plug 28 to plug into a standard wall outlet.

FIG. 5 is an illustrative view of vertical massage zones of the massage vest of the present invention. The vest 10 includes the vest body 12 having a first side 13 with at least one massage member 22 positioned thereon. Preferably, the vest 10 includes a plurality of massage members 22 positioned thereon for massaging a plurality of zones on the back and neck of the user 11 as shown in FIGS. 5 and 6. The body 12 also preferably extends so as to cover the shoulders of the user 11 so as to provide therapeutic massage to the shoulder area as well. Each massage member 22 includes a massage motor 30. The massage motor 30 causes the massage member to oscillate in a plurality of directions. Specifically, the massage motor 30 causes the massage member 22 to pivot about an axis. As shown in FIG. 3, the massage motor 30 selectively causes the massage member to pivot in at least one of a horizontal direction, a vertical direction, and a 360 degree rotational pivot. Each of the above pivot directions are shown in phantom in FIG. 3. The plurality of pivot directions allows for the user to selectively determine the style and type of massage which is provided by the vest 10 of the present invention.

The user 11 can selectively control the oscillation of the massage members 22 using the control module 24. The control module 24 is connected via wires 32, as shown in FIGS. 4–6 to each respective massage member 22 for control thereof. Operation and use of the control module 24 will be discussed hereinafter with specific reference to FIGS. 7–14. The massage members 22 of the present invention massage vest are wired together with wires 32 to provide the user means to activate and deactivate selected massage members 22.

The massage vest 10 of the present invention is powered by at least one of a portable power source 26 and a hardwire power source 28 such as a plug. Each of the power sources are selectively connectable to the control module 24 and provide power to the plurality of massage members 22. The portable power source 26 is preferably a rechargeable battery pack that enables the user 11 to be mobile while wearing the vest 10. Alternatively, the user may desire to remain stationary and therefore could use the plug 28 to plug into a standard wall outlet.

FIG. 5 shows the massage members 22 formed as vertical massage groups. There are preferably 5 vertical massage zones that are selectively controlled by the user via the control module 24. The first zone is a neck zone 34 which allows the user to select the massage members 22 positioned adjacent the neck and shoulders of the user to oscillate in a desired pattern. The second zone positioned below the neck zone 34 is the upper zone 36. The third zone is the mid-upper zone 38. The fourth zone is the mid lower zone 40, and the fifth zone is the lower zone 42. Each of the zones contains a horizontal band of massage members 22 that the user may selectively control the oscillation thereof.

FIG. 6 is an illustrative view of horizontal massage zones of the massage vest of the present invention. The vest 10 includes the vest body 12 having a first side 13 with at least one massage member 22 positioned thereon. Preferably, the vest 10 includes a plurality of massage members 22 positioned thereon for massaging a plurality of zones on the back and neck of the user 11 as shown in FIGS. 5 and 6. The body 12 also preferably extends so as to cover the shoulders of the user 11 so as to provide therapeutic massage to the shoulder area as well. Each massage member 22 includes a massage motor 30. The massage motor 30 causes the massage member to oscillate in a plurality of directions. Specifically, the massage motor 30 causes the massage member 22 to pivot about an axis. As shown in FIG. 3, the massage motor 30 selectively causes the massage member to pivot in at least one of a horizontal direction, a vertical direction, and a 360 degree rotational pivot. Each of the above pivot directions are shown in phantom in FIG. 3. The plurality of pivot directions allows for the user to selectively determine the style and type of massage which is provided by the vest 10 of the present invention.

The user 11 can selectively control the oscillation of the massage members 22 using the control module 24. The control module 24 is connected via wires 32, as shown in FIGS. 4–6 to each respective massage member 22 for control thereof. Operation and use of the control module 24 will be discussed hereinafter with specific reference to FIGS. 7–14. The massage members 22 of the present invention massage vest are wired together with wires 32 to provide the user means to activate and deactivate selected massage members 22.

The massage vest 10 of the present invention is powered by at least one of a portable power source 26 and a hardwire power source 28 such as a plug. Each of the power sources are selectively connectable to the control module 24 and provide power to the plurality of massage members 22. The portable power source 26 is preferably a rechargeable battery pack that enables the user 11 to be mobile while wearing the vest 10. Alternatively, the user may desire to remain stationary and therefore could use the plug 28 to plug into a standard wall outlet.

FIG. 6 shows the massage members 22 formed as horizontal massage groups. There are preferably 5 horizontal massage zones that are selectively controlled by the user via the control module 24. The first zone is a neck zone 44 which allows the user to select the massage members 22 positioned adjacent the neck to oscillate in a desired pattern. The second zone is a left zone 46 which massages the left side of a user. The third zone is a left center zone 48 which massages an area left of center of the vest 10. The fourth zone is a right center zone 50 which massages an area right of center of the vest 10, and the fifth zone is a right zone which massages the right side of the user 11. Each respective zone is formed from a vertical band of massage heads 22 that massage along the length of the band.

Figure 7:
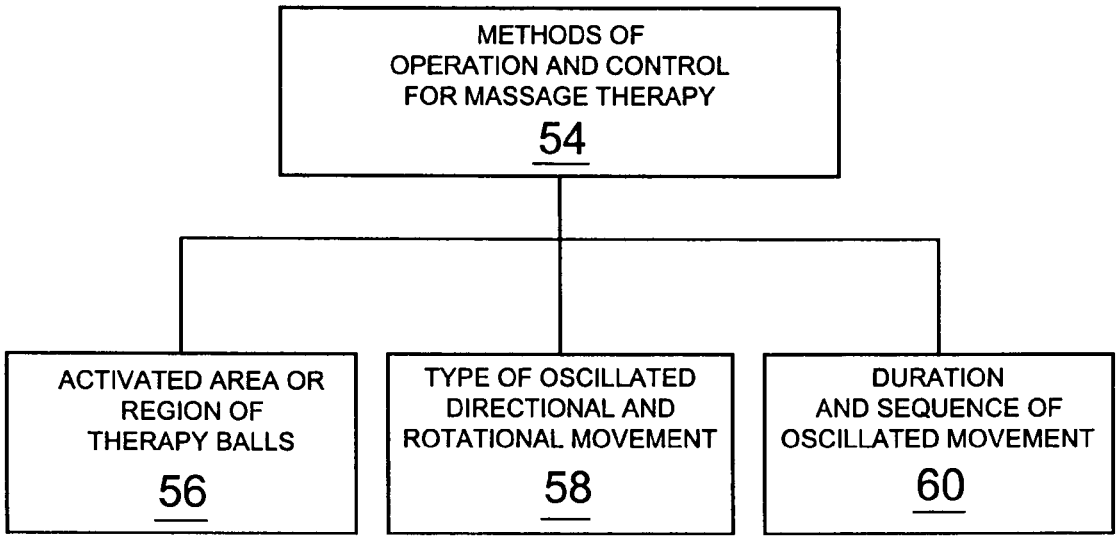
FIG. 7 is a block diagram of the operation of the massage vest of the present invention.

FIG. 7 is a block diagram of the operation of the massage vest of the present invention. The vest 10 of the present invention is controlled by a processor 54 for operating and controlling the massage therapy provided by the vest 10. Connected to the processor 54 is regional control 56, a oscillation control 58 and a duration control 60. The regional control 56 will be discussed hereinafter with specific reference to FIG. 8. The oscillation control 58 will be discussed hereinafter with specific reference to FIG. 11, and the duration control 60 will be discussed hereinafter with specific reference to FIG. 13. The processor 54 is controlled directly by the control module 24 of the present invention. The manner in which the module 24 controls the present invention will be discussed hereinafter with specific reference to FIGS. 9, 10 and 14.

Figure 8:
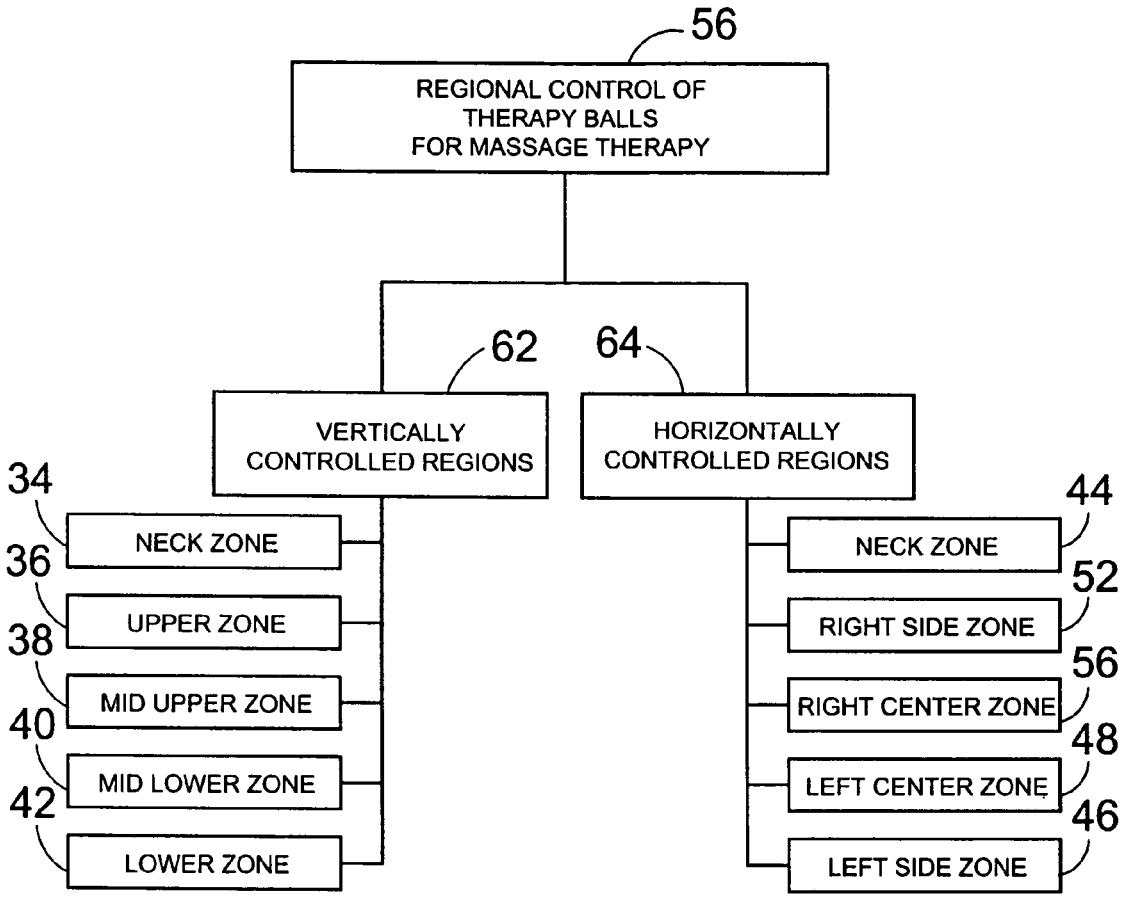
FIG. 8 is a block diagram of the control mechanism of the massage vest of the present invention.

FIG. 8 is a block diagram of the regional control mechanism 56 of the massage vest 10 of the present invention. The regional control mechanism 56 controls a vertical region 62 and a horizontal region 64. The vertical region 62 includes a neck zone 34 which allows the user to select the massage members 22 positioned adjacent the neck and shoulders of the user to oscillate in a desired pattern. The second zone positioned below the neck zone 34 is the upper zone 36. The third zone is the mid-upper zone 38. The fourth zone is the mid lower zone 40, and the fifth zone is the lower zone 42. Each of the zones contains a horizontal band of massage members 22 that the user may selectively control the oscillation thereof. The horizontal region 64 includes the neck zone 44 which allows the user to select the massage members 22 positioned adjacent the neck to oscillate in a desired pattern. The second zone is a left zone 46 which massages the left side of a user. The third zone is a left center zone 48 which massages an area left of center of the vest 10. The fourth zone is a right center zone 50 which massages an area right of center of the vest 10, and the fifth zone is a right zone which massages the right side of the user 11. Each respective zone is formed from a vertical band of massage heads 22 that massage along the length of the band.

Figure 9:
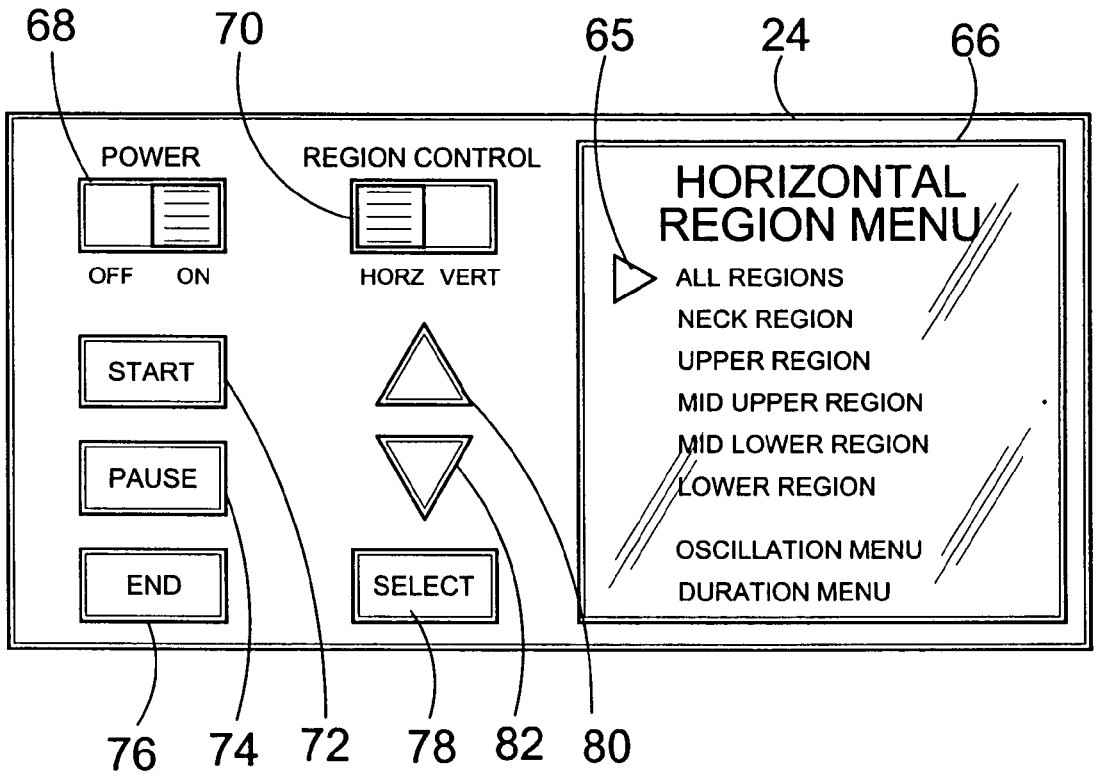
FIG. 9 is a front view of the control module of the massage vest of the present invention.

FIG. 9 is a front view of the control module 24 of the massage vest 10 of the present invention. The control module 24 includes a display screen 66 for display a menu of options thereon. Preferably the display screen is an LED display, however, any screen able to digitally display data thereon may be used. A digital pointer 65 is moveable along the list of digital text displayed on the screen 66. The control module 24 further includes a power switch 68 and a regional selection switch 70. The user toggles the regional selection switch 70 to determine the area within at least one of the horizontal or vertical regions is to be massaged. The control module 24 also includes a start button 72, a pause button 74 and an end button 76 for selectively controlling the oscillation pattern of the vest 10. An up arrow 80 and down arrow 82 allow the user to scroll the pointer 65 through the data listed on the display 66. A select button 78 allows the user to select an option indicated by the pointer 65.

FIG. 9 depicts the control module with the horizontal region control menu displayed. When the user positions the region control switch in horizontal mode, the horizontal region menu is activated. This menu provides means for the user to enable the massage members 22 of various horizontal zones to oscillate and provide massage therapy to the user.

Figure 10:
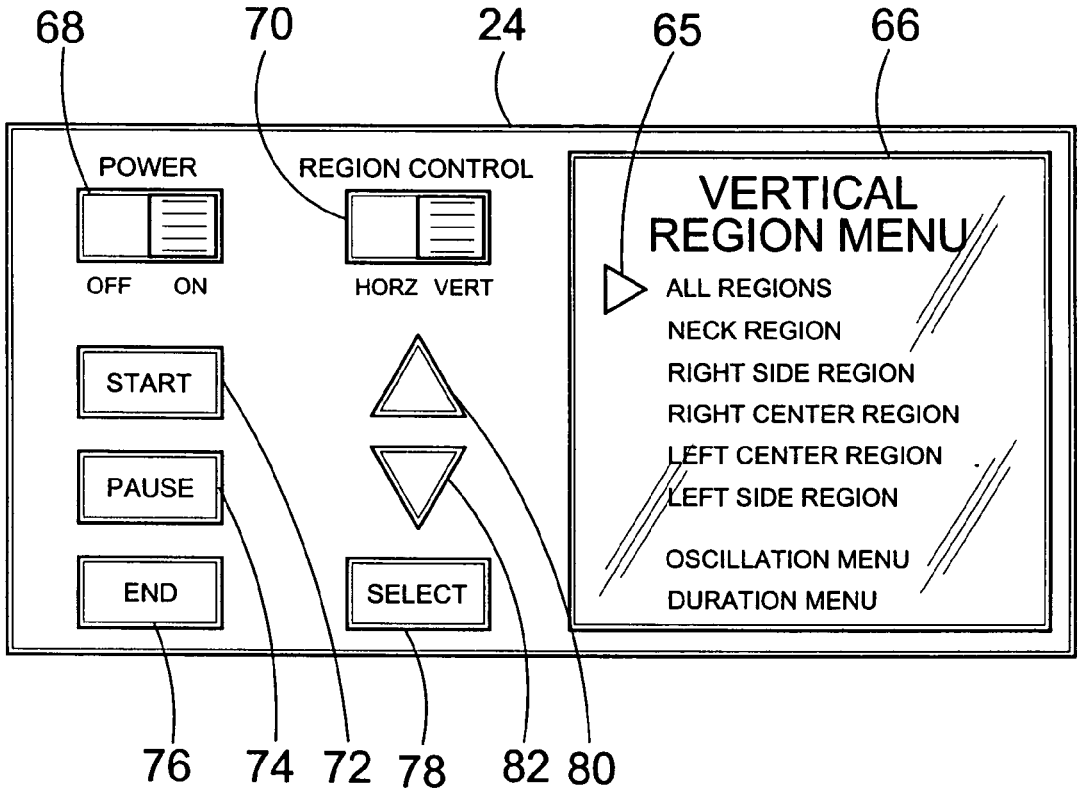
FIG. 10 is a front view of the control module of the massage vest of the present invention.

FIG. 10 is a front view of the control module of the massage vest of the present invention. The control module 24 includes the display screen 66 for display a menu of options thereon. Preferably the display screen is an LED display, however, any screen able to digitally display data thereon may be used. The digital pointer 65 is moveable along the list of digital text displayed on the screen 66. The control module 24 further includes the power switch 68 and the regional selection switch 70. The user toggles the regional selection switch 70 to determine the area within at least one of the horizontal or vertical regions is to be massaged. The control module 24 also includes the start button 72, the pause button 74 and the end button 76 for selectively controlling the oscillation pattern of the vest 10. The up arrow 80 and down arrow 82 allow the user to scroll the pointer 65 through the data listed on the display 66. The select button 78 allows the user to select an option indicated by the pointer 65.

FIG. 10 depicts the control module with the vertical region control menu displayed. When the user positions the region control switch 70 in vertical mode, the vertical region menu is activated. This menu provides means for the user to cause the massage members 22 in various vertical zones to oscillate.

Figure 11:
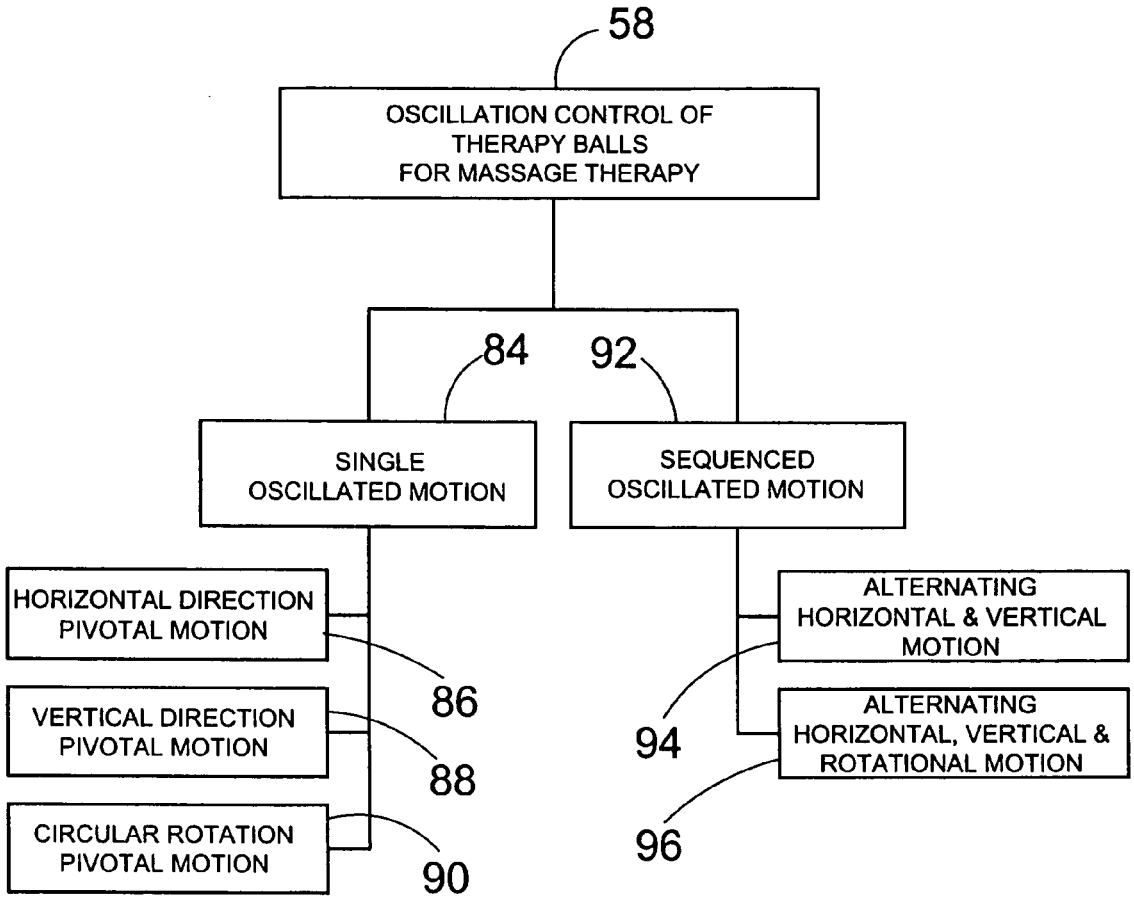
FIG. 11 is a block diagram of the oscillation controls of the massage vest of the present invention.

FIG. 11 is a block diagram of the oscillation control mechanism 58 of the massage vest 10 of the present invention. The oscillation control mechanism 58 allows the user to select a single oscillation mode 84 or a sequenced oscillation mode 92. If a user selects the single oscillation mode 84, the massage heads 22 will pivot at least one of horizontally, vertically, and rotationally about an axis. If the user selects the sequenced oscillation mode 92, then the massage heads will oscillate in a first alternating mode wherein the message heads 22 oscillate horizontally and then vertically. The user could select a second alternating mode 96 wherein the massage heads 22 oscillate horizontally, then vertically, and finally rotationally. The varying oscillation modes allow the user complete control over their massage therapy session.

Figure 12:
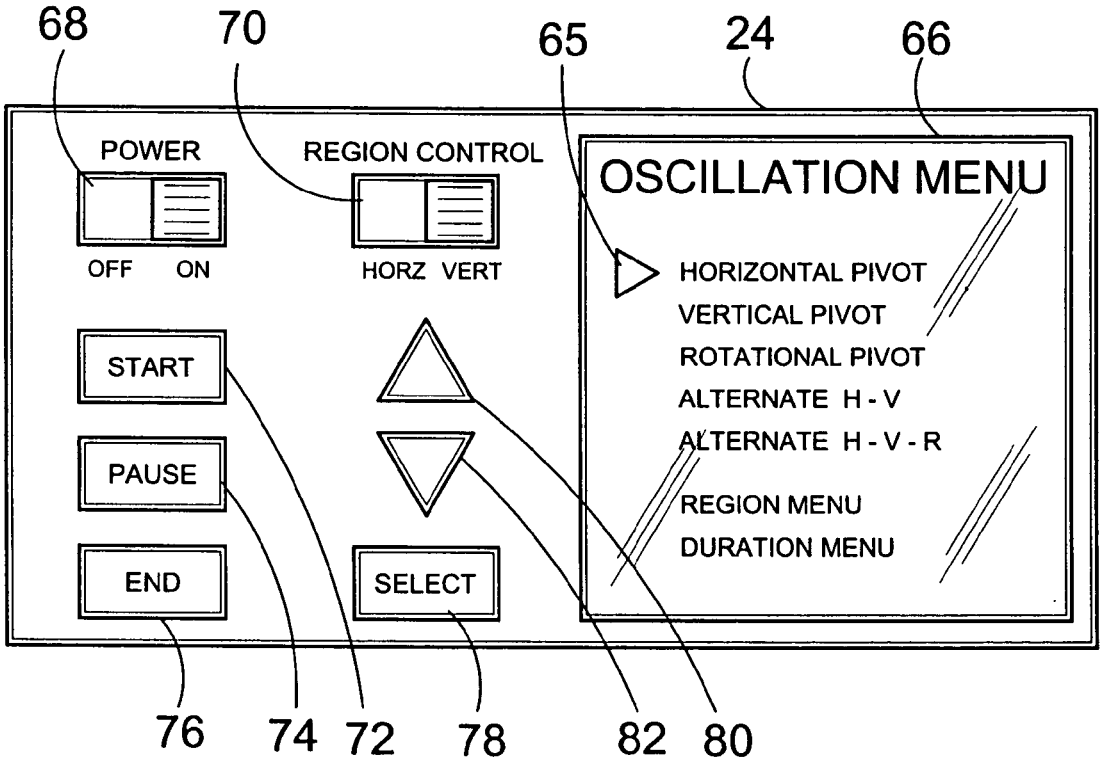
FIG. 12 is a front view of the control module of the massage vest of the present invention.

FIG. 12 is a front view of the control module of the massage vest of the present invention. The control module 24 includes the display screen 66 for display a menu of options thereon. Preferably the display screen is an LED display, however, any screen able to digitally display data thereon may be used. The digital pointer 65 is moveable along the list of digital text displayed on the screen 66. The control module 24 further includes the power switch 68 and the regional selection switch 70. The user toggles the regional selection switch 70 to determine the area within at least one of the horizontal or vertical regions is to be massaged. The control module 24 also includes the start button 72, the pause button 74 and the end button 76 for selectively controlling the oscillation pattern of the vest 10. The up arrow 80 and down arrow 82 allow the user to scroll the pointer 65 through the data listed on the display 66. The select button 78 allows the user to select an option indicated by the pointer 65.

FIG. 12 depicts the control module with the oscillation control menu displayed. The oscillation menu is activated when selected from the display screen. The oscillation menu provides means for the user to define the type(s) of directional and rotational motion of the massage heads 22.

Figure 13:
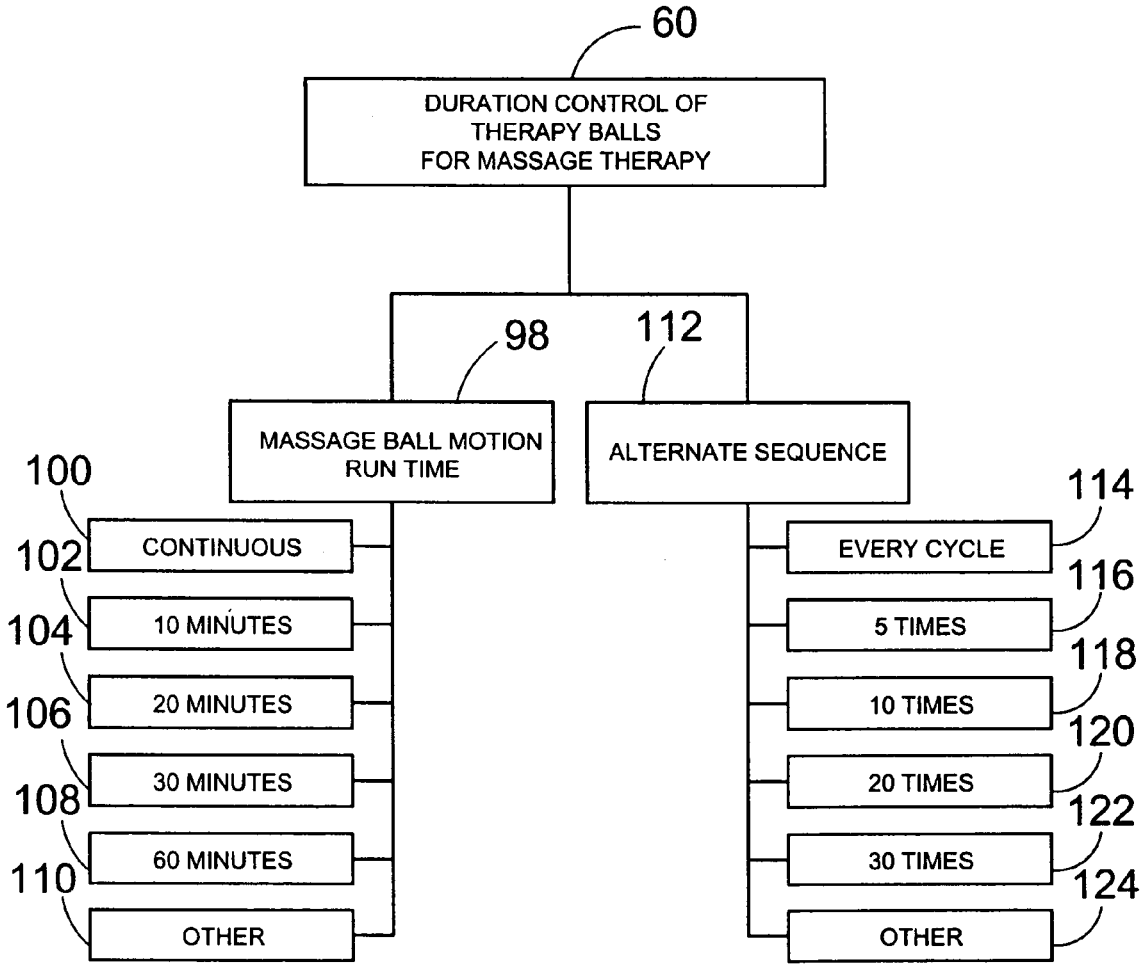
FIG. 13 is a block diagram of the duration controls of the massage vest of the present invention.

FIG. 13 is a block diagram of the duration controls of the massage vest of the present invention. The duration control mechanism 60 includes a time selector 98 and a cycle selector 112. The time selector preferably includes 6 time lengths for the user to select. The first length 100 is continuous wherein the massage heads 22 run continuously until manually stopped by the user. The second time length 102 results in the massage heads 22 oscillating for ten minutes. The third time length 104 results in the massage heads 22 oscillating for twenty minutes. The fourth time length results 106 in the massage heads 22 oscillating for thirty minutes. The fifth time length 108 results in the massage heads oscillating for sixty minutes. The sixth time length 110 results in the massage heads oscillating for a user defined period of time. The cycle selector 112 preferably includes 6 cycle selection wherein, the number times the massage heads oscillate during the sequence. The first setting 114 results in the massage heads changing sequence every cycle. The second setting 116 results in the massage heads 22 changing sequences every 5 cycles. The third setting 118 results in the massage heads 22 changing sequences every 10 cycles. The fourth setting 120 results in the massage heads 22 changing sequences every 20 cycles. The fifth setting 122 results in the massage heads 22 changing sequences every 30 cycles. The sixth setting 124 results in the massage heads 22 changing sequences at a user defined number of 10 cycles.

The massaging vest 10 provides means for defining the duration and sequence of the movements of the massage heads 22. The control module allows the user to define the length of the massage therapy. When a combination of directional or rotational motion therapy is selected from the oscillation menu, the user may also define the duration of each alternating segment of movement.

FIG. 14 a front view of the control module of the massage vest of the present invention. The control module 24 includes the display screen 66 for display a menu of options thereon. Preferably the display screen is an LED display, however, any screen able to digitally display data thereon may be used. The digital pointer 65 is moveable along the list of digital text displayed on the screen 66. The control module 24 further includes the power switch 68 and the regional selection switch 70. The user toggles the regional selection switch 70 to determine the area within at least one of the horizontal or vertical regions is to be massaged. The control module 24 also includes the start button 72, the pause button 74 and the end button 76 for selectively controlling the oscillation pattern of the vest 10. The up arrow 80 and down arrow 82 allow the user to scroll the pointer 65 through the data listed on the display 66. The select button 78 allows the user to select an option indicated by the pointer 65.

The duration menu is activated when selected from the display screen. The duration menu provides means for the user to define the length of time for the massage therapy session. When the user has defined the region, oscillation type, and duration, the massage session is activated by a start button on the control module. When the preset time interval is reach, the massage balls motion stop. Additional keys on the control module provide means for the user pause or end the session prematurely.

FIG. 15 is a flow chart of the operation and control of the massage vest of the present invention. In order to activate the massage vest 10 of the present invention, the power switch 68 must be moved from a first off position to a second on position as stated in step S200. Thereafter, the user uses the regional selection switch 70 to determine the region to be massaged as in step S204 and once the position of the switch is determined as in step S206, either the horizontal region menu is displayed on the display screen 66 as stated in step S208 or the vertical region menu is displayed as in step S210. Upon having a regional menu displayed on the display screen, step S212 requires the user depress at least one of the up arrow 80 or the down arrow 82 thereby moving the pointer 65 through the displayed list. When the pointer 65 indicates the desired region, the selection button 84 is depressed as in step S214.

The user then must determine if an additional region is to be massaged as in step S216. If the user desires to have another region massaged then step S218 requires the use to further depress at least one of the up arrow 80 or the down arrow 82 to cause the pointer 65 to indicate another region. Thereafter, the user depressed the selection button 84 to select the second highlighted region. Should the user not want another region to be massaged, the up arrow 80 or down arrow 82 are further depressed to select the oscillation menu as in step S222 which is selected by depressing the selection button 84 as in step S224. The pattern of oscillation is then chosen in step S226 and selected using the selection button in step S228. The user then selects the duration of the therapy session in step S230 and the duration mention is displayed by depressing the selection button 84 as in step S232. Once the duration menu is displayed on the display screen 66, the arrow keys 80,82 are used to move the pointer 65 to a desired duration as in step S234. Once the desired duration is highlighted, the selection button 84 is depressed as in step S236 and the desired duration is selected.

Thereafter, the user determines in step S238 whether or not alternating oscillation has been selected. If not, then the user depresses the start button 72 thereby initiating the therapy session as in step S240. If alternating oscillation has been selected, the arrow keys 80,82 are used to scroll the pointer 65 through the alternating oscillation menu as in step S242. Step S244 requires the user to depress the selection button 84 upon the pointer 65 highlighting a desired alternating oscillation pattern. Thereafter, the user depresses the start button 72 to start the therapy session as in step S246. The user can selectively pause the therapy session by depressing the pause button 74 or end the session by depressing the end button 76.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A wearable massage apparatus comprising:

a) a vest comprising a main body having an inner side covering a neck, shoulders, and back of a user;

b) a plurality of massage heads positioned on said inner side of said body adjacent the neck, shoulders and back of said user, each massage head having a base attached to a massage motor for oscillating said massage head by pivoting said massage head in a horizontal direction, a vertical direction, or a 360 degree rotational pivot;

c) means for securing said main body to the user;

d) a control module having a processor connected to said massage heads for controlling oscillation and direction of oscillation thereof, each said massage head having a ball shaped free end extending from the inner side of said vest, said ball shaped free end being oscillated by a massage motor connected to an opposite end of said massage head; and e) a source of power for said control module and massage motors;

wherein said plurality of massage heads are arranged in vertical and horizontal massage groups, wherein each respective vertical massage group is formed as horizontal bands of said massage heads, said vertical massage group made up of a neck band, wherein said plurality of massage heads contained therein oscillate and massage the neck of a user, an upper band wherein said plurality of massage heads contained therein oscillate and massage the shoulders of a user, a mid upper band wherein said plurality of massage heads contained therein oscillate and massage the upper back of a user, a mid lower band wherein said plurality of massage heads contained therein oscillate and massage the middle of a user's back, and a lower band wherein said plurality of massage heads contained therein oscillate and massage the middle of a user's back, and said horizontal massage group made up of vertical bands of said massage heads including a neck band wherein said plurality of massage heads contained therein oscillate and massage the neck of a user, a right band wherein said plurality of massage heads contained therein oscillate and massage the fight side of a user's back, a right-center band wherein said plurality of massage heads contained therein oscillate and massage an area to the right of the user's spine, a left-center band wherein said plurality of massage heads contained therein oscillate and massage an area to the left of the user's spine, and a left band wherein said plurality of massage heads contained therein oscillate and massage a left side of user's back.

2. The apparatus as recited in claim 1 in which said control module comprises:

a) an on/off power switch;

b) a screen;

c) a region control switch for toggling between a horizontal and vertical group of massage heads, said screen displaying a menu for each of the horizontal and vertical groups as selected by said region control switch, the horizontal region menu listing all regions, neck region, upper region, mid upper region, mid lower region, lower region, oscillation menu, and duration menu, and the vertical menu listing all regions, neck region, right side region, right center region, left center region, left side region, oscillation menu, and duration menu;

d) up and down scrolling arrows for said menu on said screen;

e) a select button;

f) said oscillation menu listing horizontal pivot, vertical pivot, rotational pivot, alternate horizontal and vertical pivot, alternate horizontal, vertical and rotational pivot of selected massage heads; and g) start button.

* * * * *